US008151689B2

(12) United States Patent
Dantlgraber

(10) Patent No.: US 8,151,689 B2
(45) Date of Patent: Apr. 10, 2012

(54) RADIAL PISTON MACHINE

(75) Inventor: Jörg Dantlgraber, Lohr am Main (DE)

(73) Assignee: Robert Bosch GmbH, Stuttgart (DE)

( * ) Notice: Subject to any disclaimer, the term of this patent is extended or adjusted under 35 U.S.C. 154(b) by 1114 days.

(21) Appl. No.: 12/018,608

(22) Filed: Jan. 23, 2008

(65) Prior Publication Data

US 2008/0205802 A1 Aug. 28, 2008

(30) Foreign Application Priority Data

Jan. 26, 2007 (DE) ..... 10 2007 004 069

(51) Int. Cl.
*F01B 1/00* (2006.01)

(52) U.S. Cl. ..... 92/72; 92/158; 92/DIG. 2

(58) Field of Classification Search ..... 92/72, 158, 92/DIG. 2
See application file for complete search history.

(56) References Cited

U.S. PATENT DOCUMENTS 6,764,285 B1 * 7/2004 Kellner ..... 92/72
7,513,190 B2 * 4/2009 Boehland et al. ..... 92/158

FOREIGN PATENT DOCUMENTS

DE 3531632 3/1987

* cited by examiner

*Primary Examiner* — Daniel Lopez
(74) *Attorney, Agent, or Firm* — Boyle Fredrickson, S.C.

(57) ABSTRACT

There is disclosed a radial piston machine comprising a cylinder block having at least one bore in which a piston supported on an eccentric disk is movably guided via roll bodies, wherein at least one hydrostatic relieving field is provided between the piston and the roll body. According to the invention, the active surface $A_2$ of the relieving field is equal to or larger than the active piston area $A_1$ of the piston restricting a cylinder chamber and the relieving field is in fluid communication with the cylinder chamber via a hydraulic resistance.

7 Claims, 2 Drawing Sheets

RADIAL PISTON MACHINE

CROSS REFERENCE TO RELATED APPLICATION

This application claims priority under 35 USC 119(b) to German Application no. DE 10 2007 004 069.7 filed Jan. 26, 2007, entitled "Radial Piston Machine", the entirety of which is expressly incorporated by reference herein.

BACKGROUND OF THE INVENTION

1. Field of the Invention

The invention relates to a radial piston machine, and more particularly, a radial piston machine that minimizes wear and power loss.

2. Description of the Related Art

Such a radial piston machine known, for instance, from DE 35 31 632 A1 comprises a rotor in the form of a cylinder block which accommodates a plurality of pistons and is rotatably disposed in a lifting ring (eccentric disk) fixed to the casing. The piston is guided in a radially extending cylinder bore of the rotor and is supported on the lifting ring via roll bodies in the form of cylindrical rollers. In radial piston machines of this type the force is transmitted from the eccentric disk to the pistons via the rollers rolling off the lifting cam. Such machines excel by a compact and cost-effective design as well as by their high-pressure capability.

From the general prior art it is furthermore known to provide a hydrostatic relieving field between the piston and the roller. For this purpose, at the front the cylindrical piston is provided with a pocket restricting the relieving field by the roller.

It is a drawback in such radial piston machines that the surface of the hydrostatic relieving field is smaller than the piston area. Therefore, the differential force must be mechanically absorbed. This causes a mixed friction resulting in wear, power loss and a poor starting moment of the radial piston machine.

Compared to this, the object underlying the invention is to provide a radial piston machine in which an improved hydrostatic support of the pistons with respect to the roll bodies is obtained.

SUMMARY OF THE INVENTION

This object is achieved by a radial piston machine in which an improved hydrostatic support of the pistons with respect to the roll bodies is obtained.

The radial piston machine according to the invention comprises a cylinder block having at least one radially extending bore in which a piston supported via roll bodies on an eccentric disk is movably guided, wherein between the piston and the roll bodies at least one hydrostatic relieving field is provided. In accordance with the invention, the active surface of the relieving field is equal to or larger than the active piston area of the piston restricting a cylinder chamber and the relieving field is in fluid communication with the cylinder chamber via a hydraulic resistance.

This solution shows the advantage over the prior art that due to the hydrostatic support of the roll bodies wear and power loss are at least strongly reduced by the low friction and the starting moment of the radial piston machine is improved.

It has turned out to be especially advantageous when substantially cylindrical rollers are used as roll bodies.

According to an especially preferred embodiment of the invention, each of the pistons supports a bearing shell having at least one pocket forming the hydrostatic relieving field.

The width and/or length of the bearing shell is preferably larger than the outer diameter of the piston so that the relieving surface enlarged vis-à-vis the piston area on the cylinder chamber side is obtained.

It has turned out as especially advantageous in terms of manufacture, when the bearing shell has a substantially square cross-section on the roll body side.

Preferably the bearing shells are provided with a circumferential support area adapted to the geometry of the roll bodies.

In a variant of the invention which is especially easy to manufacture the bearing shell is an insert adapted to be inserted in the piston. The insert is inserted, for instance via a projection, into a corresponding receiving bore of the piston.

According to an alternative embodiment, the bearing shell is formed integrally with the piston.

For connecting the hydrostatic relieving field to a cylinder chamber of the cylinder block for instance a through bore which is communicated via a pressure medium passage of the piston to the cylinder chamber assigned thereto can be passed through the bearing shell.

Other advantageous developments of the invention are the subject matter of further subclaims.

BRIEF DESCRIPTION OF THE DRAWINGS

Hereinafter a preferred embodiment of the invention is illustrated in detail by way of schematic drawings, in which.

DETAILED DESCRIPTION OF THE DRAWINGS

Figure 1:
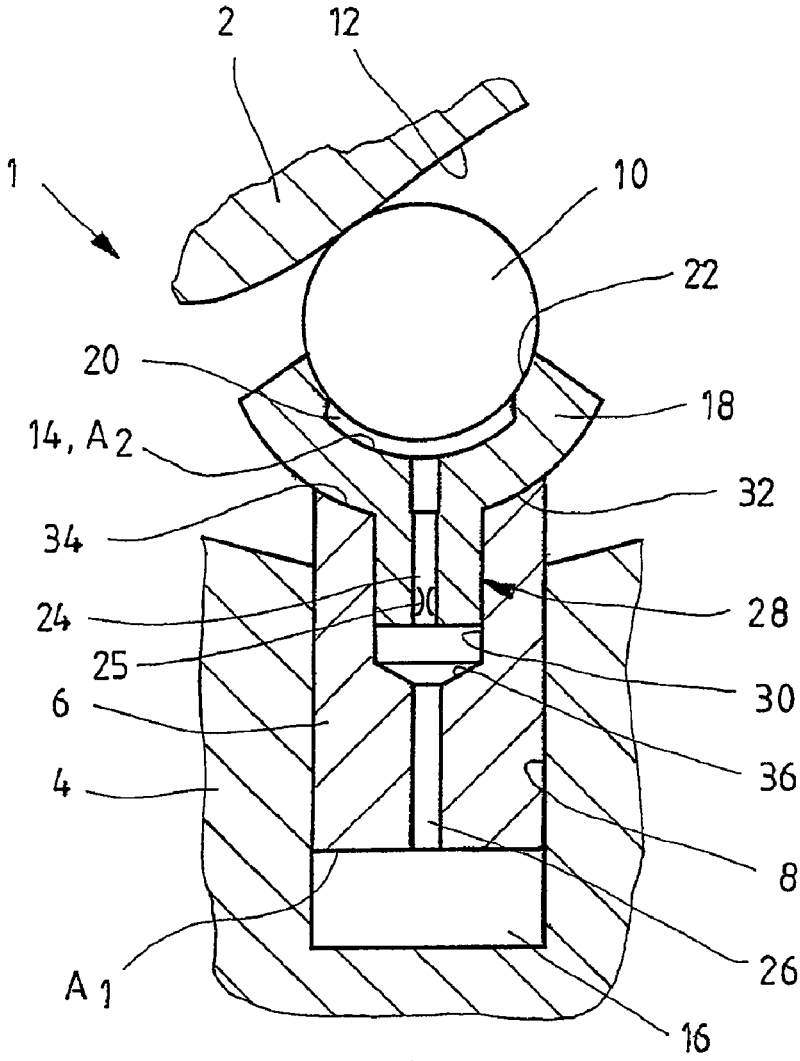
FIG. 1 shows a cross-section of a radial piston machine according to the invention in the area of a piston.

FIG. 1 shows a section across a radial piston machine 1 according to the invention in the form of a multi-stroke radial piston motor.

The radial piston machine 1 comprises a multi-part housing consisting substantially of two casing covers not represented between which an eccentric disk 2 is arranged. The eccentric disk 2 fixed to the housing encompasses a rotor in the form of a cylinder block 4 which accommodates a plurality of pistons 6. The latter are guided in respective radially extending cylinder bores 8 of the cylinder block 4 and are supported via a roll body 10 on a lifting cam 12 of the eccentric disk 2. It has turned out to be especially advantageous when substantially cylindrical rollers are used as roll bodies 10. The rollers 10 rolling off the lifting cam 12 transmit the forces occurring from the eccentric disk 2 to the pistons 6. Between the piston 6 and the roller 10 a hydrostatic relieving field 14 is arranged which is in fluid communication with a cylinder chamber 16 of the cylinder block 4. On the roller bearing side the pistons 6 are provided with a bearing shell 18 which is an insert inserted into the piston 6 and has a pocket 20 forming the hydrostatic relieving field 14. The bearing shell 18 is provided with a circumferential concave support area 22 adapted to the geometry of the roller 10 and an axial bore 24 which ends in the pocket 20 and is communicated via a pressure medium passage 26 of the piston to the cylinder chamber 16 assigned thereto is passed through the bearing shell. In the fluid communication between the hydrostatic relieving field 14 and the cylinder chamber 16 a throttle 25, which in the present case is a constriction of the axial bore 24 of the bearing shell 18, but which may also be screwed into the axial bore 24 of the bearing shell 18 or into the pressure medium passage 26 of the piston 6 as separate component part, is provided as hydraulic resistance. Under certain circumstances also the hydraulic resistance of the fluid path between the cylinder chamber 16 and the relieving field 14 can be sufficiently high, even if an additional throttle evident as such is not provided at all. Then the entire fluid path constitutes the throttle.

The bearing shell 18 is inserted via a cylindrical projection 28 into a corresponding receiving bore 30 of the piston 6 and is brought into contact with a corresponding concave end face 34 of the piston 6 by means of a contact surface 32 convex in sections so that the bearing shell 18 is fixedly connected to the piston 6. The receiving bore 30 is transformed via a circumferential inclined surface 36 into the pressure medium passage 26 which permits a pressure medium communication from the cylinder chamber 16 via the axial bore 24 of the bearing shell 18 into the pocket 20, i.e. to the hydrostatic relieving field 14. The basis of the relieving field 14 has a concave shape corresponding to the convex cylindrical roller 10.

In an embodiment not represented the bearing shell 18 is integrally formed with the piston 6.

Figure 2:
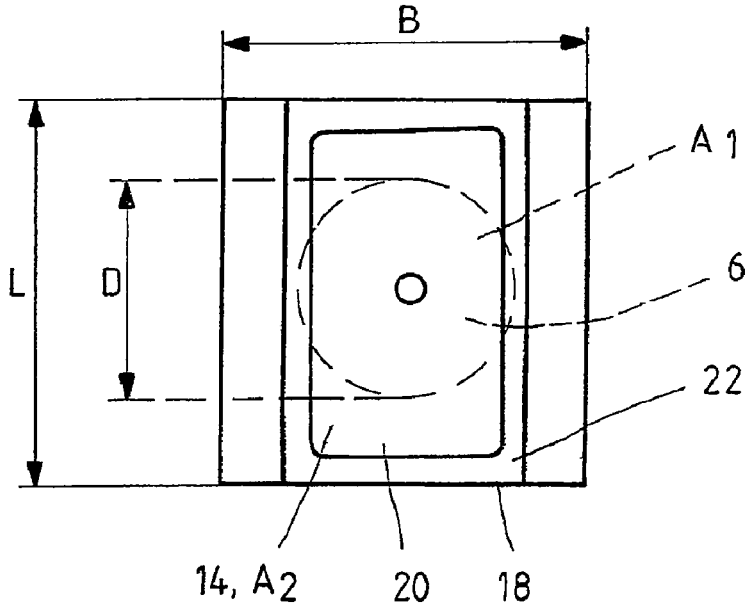
FIG. 2 is a top view of the piston from FIG. 1.

According to FIG. 2 showing a top view of the piston 6 from FIG. 1, the active surface $A_2$ (pocket area) of the hydrostatic relieving field 14 is larger than the active piston area $A_1$ of the piston on the cylinder chamber side ($A_2>A_1$). Due to the hydrostatic relieving surface $A_2$ designed larger than the piston area $A_1$ a hydrostatic bearing substantially preventing mixed friction between the piston 6 and the roller 10 is obtained concerning the roller 10 so that the wear and the power loss are at least strongly reduced and the starting moment of the radial piston machine 1 is improved. The bearing shell 18 has a substantially rectangular cross-section, wherein the width B and the length L of the bearing shell 18 are larger than the outer diameter D of the piston 6 so that the relieving surface 14 enlarged vis-à-vis the piston area $A_1$ on the cylinder chamber side is obtained.

In operation also the relieving field 14 is pressurized via the throttle 25 in the phases in which high pressure is prevailing in the cylinder chamber 16. The pressure $p_2$ in the relieving field is adjusted according to the equation $p_2 \times A_2 = p_1 \times A_1$, wherein the pressure $p_1$ is the pressure in the cylinder chamber 16. Since $A_2$ is higher than $A_1$, the pressure $p_2$ is lower than the pressure $p_1$. The roller 10 is slightly lifted off the support area 22 with said pressure $p_2$. By the gap between the support area 22 and the roller 10 a second throttle is realized through which the fluid quantity flowing to the relieving field 14 via the throttle 25 is discharged into the casing of the radial piston motor 1 in which low pressure is prevailing. If the gap becomes too large due to interference, the pressure $p_2$ falls below the necessary value. The balance of forces at the piston 6 including the bearing shell 18 is disturbed, the roller 10, on the one hand, and the piston 6 and the bearing shell 18, on the other hand, move toward each other and the gap is reduced. The pressure $p_2$ is increased again to its value given by the above equation. If the gap becomes too small due to interference, the pressure $p_2$ increases above the necessary value. The balance of forces at the piston 6 including the bearing shell 18 is disturbed, the roller 10, on the one hand, and the piston 6 and the bearing shell 18, on the other hand, move apart from each other and the gap is increased. The pressure $p_2$ is reduced again to its value given by the above equation.

Thus the roller 10 does not rest directly on the support area 22 of the bearing shell 18. Rather, between the roller 10 and the support area 22 of the bearing shell 18 a small clearance is provided by virtue of the hydrostatic support of the roller 10 on the relieving field 14. Practically no wear does occur at the roller 10 and the bearing shell 18 in this operating phase.

If the cylinder chamber 16 is pressure-relieved, namely in the operating phases in which the roller 10 moves upward along the lifting cam 12 and urges the piston 6 to the inside, the roller 10 can rest on the support area 22. Hardly any wear does occur, because the force required for displacing the piston 6 is only small.

Figure 3:
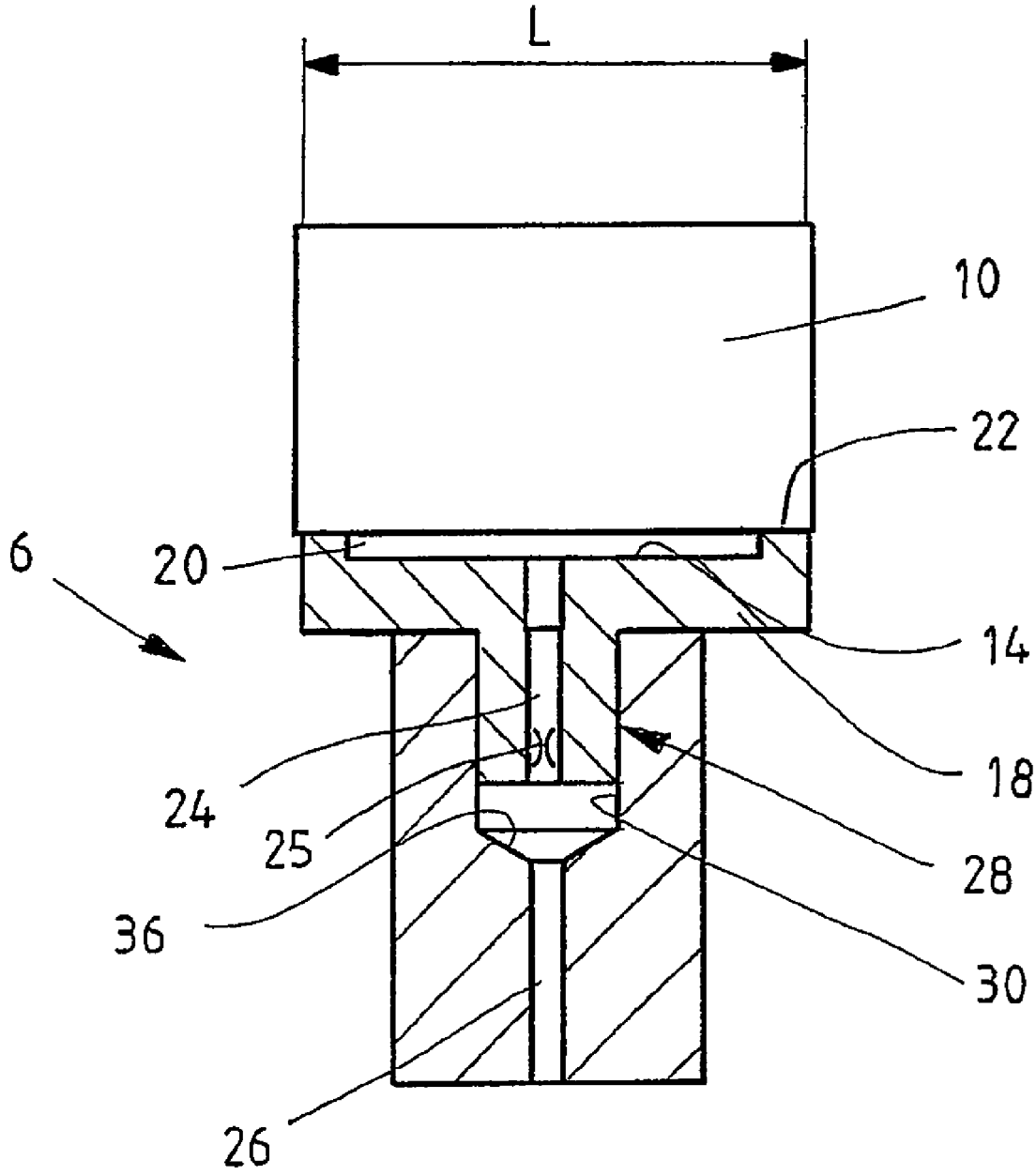
FIG. 3 is a side view of the piston from FIG. 1 including roll body.

As one can take especially from FIG. 3 illustrating a side view of the piston 6 from FIG. 1 including the roll body 10, a particularly compact arrangement of the machine 1 with minimum wear is obtained, when the length L of the bearing shell 18 substantially corresponds to the length of the roller 10.

The radial piston machine 1 according to the invention is not restricted to the described rollers 10, rather different roll bodies, especially balls, known from prior art can be used. The radial piston machine 1 is basically adapted to be used also in variants having a fixed cylinder block 4 and a rotating casing.

There is disclosed a radial piston machine comprising a cylinder block 4 having at least one bore 8 in which a piston 6 supported on an eccentric disk 2 is movably guided via roll bodies 10, wherein at least one hydrostatic relieving field 14 is provided between the piston 6 and the roll body 10. According to the invention, the active surface $A_2$ of the relieving field 14 is equal to or larger than the active piston area $A_1$ of the piston 6 restricting a cylinder chamber 16 and the relieving field 14 is in fluid communication with the cylinder chamber 16 via a hydraulic resistance 25.

Although the best mode contemplated by the inventors of carrying out the present invention is disclosed above, practice of the above invention is not limited thereto. It will be manifest that various additions, modifications and rearrangements of the features of the present invention may be made without deviating from the spirit and the scope of the underlying inventive concept.

The invention claimed is:

1. A radial piston machine, comprising a cylinder block having at least one bore in which a piston supported on an eccentric disc via a roll body is movably guided, wherein between the piston and the roll body at least one hydrostatic relieving field is provided, wherein the active surface ($A_2$) of the relieving field is equal to or larger than the active piston area ($A_1$) of the piston restricting the cylinder chamber and that the relieving field is in fluid communication with the cylinder chamber via a hydraulic resistance, wherein a bearing shell including a pocket forming the hydrostatic relieving field is assigned to the piston; and, wherein the bearing shell is in the form of an insert inserted into the piston.

2. A radial piston machine according to claim 1, wherein a substantially cylindrical roller is used as the roll body.

3. A radial piston machine according to claim 1, wherein the width (B) and/or the length (L) of the bearing shell is larger than the outer diameter (D) of the piston.

4. A radial piston machine according to claim 1, wherein the bearing shell has a substantially rectangular cross-section.

5. A radial piston machine according to claim 1 wherein the bearing shell has a circumferential support area adapted to the geometry of the roll body.

6. A radial piston machine according to claim 1, wherein the bearing shell is formed integrally with the piston.

7. A radial piston machine according to claim 1, wherein the hydrostatic relieving field is in fluid communication with a cylinder chamber of the cylinder block via a bore in the bearing shell and in the piston.

* * * * *